US009564081B2

(12) United States Patent
Ma

(10) Patent No.: US 9,564,081 B2
(45) Date of Patent: Feb. 7, 2017

(54) PIXEL COMPENSATION CIRCUIT, ARRAY SUBSTRATE AND DISPLAY APPARATUS

(71) Applicant: BOE TECHNOLOGY GROUP CO., LTD., Beijing (CN)

(72) Inventor: Zhanjie Ma, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 40 days.

(21) Appl. No.: 14/436,208

(22) PCT Filed: Aug. 27, 2014

(86) PCT No.: PCT/CN2014/085320

§ 371 (c)(1),
(2) Date: Apr. 16, 2015

(87) PCT Pub. No.: WO2015/143835

PCT Pub. Date: Oct. 1, 2015

(65) Prior Publication Data

US 2016/0180772 A1 Jun. 23, 2016

(30) Foreign Application Priority Data

Mar. 24, 2014 (CN) ..... 2014 1 0111760

(51) Int. Cl.
*G09G 3/32* (2016.01)

(52) U.S. Cl.
CPC ..... *G09G 3/3258* (2013.01); *G09G 3/3233* (2013.01); *G09G 2300/0819* (2013.01);
(Continued)

(58) Field of Classification Search
CPC ..... G09G 3/3233; G09G 3/3258; G09G 2300/0819; G09G 2300/0842; G09G 2300/0861; G09G 2310/061; G09G 2310/08
See application file for complete search history.

(56) References Cited

U.S. PATENT DOCUMENTS 8,917,264 B2 12/2014 Minami et al.
2007/0118781 A1* 5/2007 Kim ..... G09G 3/3233 714/727
(Continued)

FOREIGN PATENT DOCUMENTS

CN 101281723 A 10/2008
CN 102646386 A 8/2012
(Continued)

OTHER PUBLICATIONS

International Search Report of PCT/CN2014/085320 in Chinese with English translation, mailed Jan. 6, 2015.
(Continued)

*Primary Examiner* — Alexander Eisen
*Assistant Examiner* — Abhishek Sarma
(74) *Attorney, Agent, or Firm* — Collard & Roe, P.C.

(57) ABSTRACT

There are provided a pixel compensation circuit, an array substrate, and a display apparatus. The pixel compensation circuit comprises an organic light emitting diode (D1), a driving transistor (M1), first to fifth switch elements (M2-M6) and a storage capacitor (C1), wherein an anode of the organic light emitting diode (D1) is connected to a second terminal of the first switch element (M2); a first terminal of the first switch element (M2) is connected to an output terminal of the driving transistor (M1) and a first terminal of the fifth switch element (M6); a control terminal of the driving transistor (M1) is connected to a second terminal of the third switch element (M4), a second terminal of the fifth switch element (M6) and a first terminal of the storage capacitor (C1); and a second terminal of the storage capacitor (C1) is connected to a second terminal of the fourth switch element (M5) and a second terminal of the second switch element (M3). The pixel compensation circuit not only has a function of compensating for the threshold voltage offset, but also has the function of compensating for influence of signal voltage attenuation on current.

13 Claims, 1 Drawing Sheet

(52) U.S. Cl.
CPC ..... *G09G 2300/0842* (2013.01); *G09G 2300/0861* (2013.01); *G09G 2310/061* (2013.01); *G09G 2310/08* (2013.01)

(56) References Cited

U.S. PATENT DOCUMENTS

| | | | | |
|---|---|---|---|---|
| 2011/0109299 | A1* | 5/2011 | Chaji | G09G 3/3283 324/76.11 |
| 2012/0062545 | A1* | 3/2012 | Kim | G09G 3/3233 345/212 |
| 2012/0287103 | A1 | 11/2012 | Wu et al. | |

FOREIGN PATENT DOCUMENTS

| | | | |
|---|---|---|---|
| CN | 102819996 | A | 12/2012 |
| CN | 102930824 | A | 2/2013 |
| CN | 103886838 | A | 6/2014 |
| CN | 203733450 | U | 7/2014 |
| KR | 20130132708 | A | 12/2013 |

OTHER PUBLICATIONS

Notice of Transmittal of the International Search Report of PCT/CN2014/085320 in Chinese, mailed Jan. 6, 2015.

Written Opinion of the International Searching Authority of PCT/CN2014/085320 in Chinese with English translation, mailed Jan. 6, 2015.

Chinese Office Action of Chinese Application No. 201410111760.X, mailed Apr. 23, 2015 with English translation.

Second Chinese Office Action issued by SIPO for Chinese Application No. 201410111760.X, mailed Aug. 25, 2015 with English translation.

Notification to Grant the Patent Right (Notice of Allowance) for Chinese Application No. 201410111760.X issued on Feb. 26, 2016 in Chinese with an English translation.

Issued Patent for Issued Patent in Chinese Application No. 201410111760.X (CN 103886838 B) which was granted on Apr. 6, 2016 in Chinese with the Chinese granted claims with an English translation.

* cited by examiner

PIXEL COMPENSATION CIRCUIT, ARRAY SUBSTRATE AND DISPLAY APPARATUS

CROSS REFERENCE TO RELATED APPLICATIONS

This application is the National Stage of PCT/CN2014/085320 filed on Aug. 27, 2014, which claims priority under 35 U.S.C. §119 of Chinese Application No. 201410111760.X filed on Mar. 24, 2014, the disclosure of which is incorporated by reference.

TECHNICAL FIELD

The present disclosure relates to a pixel compensation circuit, an array substrate, and a display apparatus.

BACKGROUND

Active matrix organic light emitting diode (AMOLED) display is a display technique applicable to a TV set and a mobile device, and has wide application prospect in power-sensitive portable electronic devices due to its characteristics of low power consumption, low cost and large size.

At present, in the AMOLED display field, in particular the large-size substrate design, a backplane thin film transistor (TFT) has non-uniformity and stability problems in the manufacturing process, which will not only cause threshold voltage offset due to non-uniformity of a driving OLED current, but also have the problem of TFT stability decrease after a long time of turning on bias voltage.

In the prior art, there are many AMOLED compensation circuit designs performed by only considering the problem of threshold voltage offset but neglecting the problem that load on a signal line will be increasing with the trend of the large-size AMOLED, thereby resulting in occurrence of voltage attenuation on the signal line, so as to influence the uniformity of current in the display area.

SUMMARY

In view of the deficiencies in the prior art, the present disclosure provides a pixel compensation circuit, an array substrate and a display apparatus, which not only has a function of compensating for the threshold voltage offset but also has a function of compensating for influence of signal voltage attenuation on current, and at the same time greatly reduces influence of signals from frame to frame According to one aspect of the present disclosure, there is provided a pixel compensation circuit, comprising an organic light emitting diode, a driving transistor, first to fifth switch elements and a storage capacitor, wherein an anode of the organic light emitting diode is connected to a second terminal of the first switch element; a first terminal of the first switch element is connected to an output terminal of the driving transistor and a first terminal of the fifth switch element; a control terminal of the driving transistor is connected to a second terminal of the third switch element, a second terminal of the fifth switch element and a first terminal of the storage capacitor; and a second terminal of the storage capacitor is connected to a second terminal of the fourth switch element and a second terminal of the second switch element.

Alternatively, the pixel compensation circuit further comprises: a first driving voltage line connected to an input terminal of the driving transistor; and a second driving voltage line connected to a cathode of the organic light emitting diode.

Alternatively, the pixel compensation circuit further comprises a data writing voltage line connected to a first terminal of the second switch element.

Alternatively, the pixel compensation circuit further comprises an initialization voltage line connected to a first terminal of the third switch element and a first terminal of the fourth switch element.

Alternatively, the pixel compensation circuit further comprises a writing switch signal line connected to a control terminal of the second switch element and a control terminal of the fifth switch element.

Alternatively, the pixel compensation circuit further comprises a resetting switch signal line connected to a control terminal of the third switch element.

Alternatively, the pixel compensation circuit further comprises a driving switch signal line connected to a control terminal of the first switch element and a control terminal of the fourth switch element.

As an example, both the driving transistor and the first to fifth switch elements can be thin film transistors.

According to another aspect of the present disclosure, there is provided an array substrate comprising any one of the above pixel compensation circuit.

According to another aspect of the present disclosure, there is provided a display apparatus comprising any one of the above array substrate.

The structure of the pixel compensation circuit of the present disclosure can make the current that finally drives OLED to emit light is unrelated with the threshold voltage Vth and the bias voltage $V_{DD}$. The pixel compensation circuit of the present disclosure can not only compensate OLED current deviation caused by the threshold voltage bias, but also has the function of compensating influence of signal voltage attenuation on current.

At the same time, such circuit structure further has a function of resetting the potential at the gate of the driving transistor from frame to frame, which guarantees to minimize the influence of an upper frame signal on a lower frame signal and greatly reduces the influence of a signal from frame to frame.

Of course, any product or method that implements the present disclosure does not necessarily need to realize the above all advantages simultaneously.

DETAILED DESCRIPTION

In order to make the purpose, technical solutions and advantages of embodiments of the present disclosure more clear, the technical solutions in the embodiments of the present disclosure will be described below clearly and completely by combining with the accompanying figures in the embodiments of the present disclosure. Apparently, the embodiments described below are a part of the embodiments of the present disclosure, but not all the embodiments. Based on the embodiments in the present disclosure, all the other embodiments obtained by those skilled in the art without paying any inventive word belong to the protection scope of the present disclosure.

First Embodiment

Figure 1:
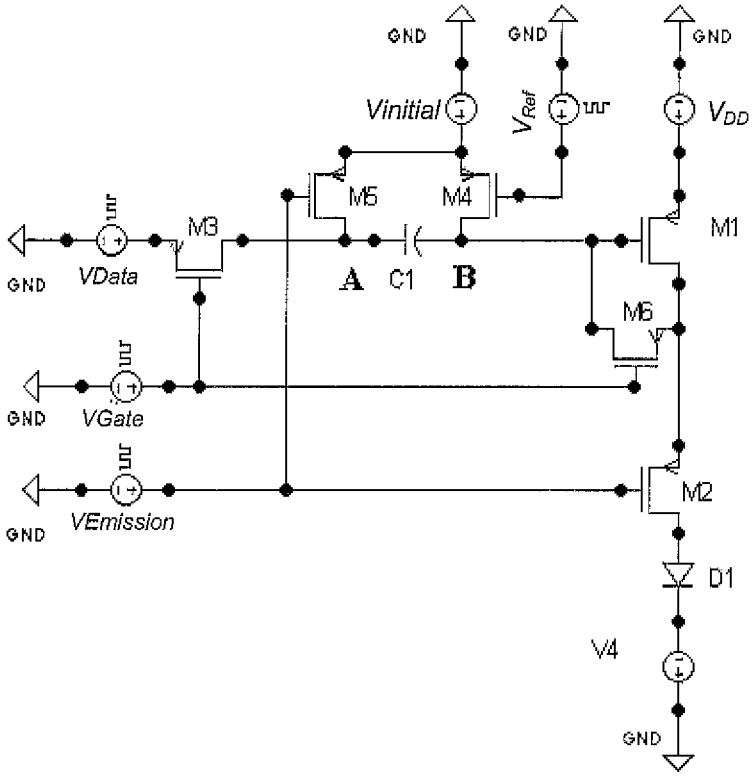
FIG. 1 is a circuit structure diagram of a pixel compensation circuit in an embodiment of the present disclosure.

There provides in an embodiment of the present disclosure a pixel compensation circuit. As shown in FIG. 1, the circuit comprises: an organic light emitting diode D1, a driving transistor M1, first to fifth switch elements M2 to M6 and a storage capacitor C1.

In the circuit as shown in FIG. 1, an anode of the organic light emitting diode D1 is connected to a second terminal of the first switch element M2. A first terminal of the first switch element M2 is connected to a second terminal (output terminal) of the driving transistor M1 and a first terminal of the fifth switch element M6.

A control terminal of the driving transistor M1 is connected to a second terminal of the third switch element M4, a second terminal of the fifth switch element M6 and a first terminal (corresponding to node B in FIG. 1) of the storage capacitor C1.

A second terminal of the storage capacitor C1 is connected to a second terminal of the fourth switch transistor M5 and a second terminal (corresponding to node A in FIG. 1) of the second switch element M3.

Herein, the switch elements refer to elements whose first terminal and second terminal are controlled by a signal of the control terminal whether or not to be connected. Of course, the switch elements can be implemented by a variety of specific electrical elements.

Thus, this circuit has the basic construction and connecting relationships as described above, wherein the driving transistor M1, the first switch element M2 (which can be regarded as a conducting wire when it is turned on) and the organic light emitting diode D1 constitute the basic OLED driving relationship, while the first to fifth switch elements can be controlled by signals at their respective control terminals to be in a turn-on/turn-off state respectively.

Further, in order to realize the functions of the circuit, it needs to apply necessary bias in the circuit. For this reason, the circuit further comprises:

a first driving voltage line, applied thereto a positive operating bias voltage $V_{DD}$, and connected to a first terminal (input terminal) of the driving transistor M1;

a second driving voltage line, applied thereto a negative operating bias voltage V4, and connected to a cathode of the organic light emitting diode D1;

a data writing voltage line, applied thereto a data writing voltage VData that sets how the OLED in the circuit emits light, and connected to a first terminal of the second switch element M3; and an initialization voltage line, applied thereto a constant initialization voltage Vinitial, and connected to a first terminal of the third switch element M4 and a first terminal of the fourth switch element M5.

Furthermore, three signal lines are adopted herein to control turn-on or turn-off of each switch element respectively. That is, the circuit further comprises:

a writing switch signal line, applied thereto a writing switch signal voltage VGate, and connected to a control terminal of the second switch element M3 and a control terminal of the fifth switch element M6;

a resetting switch signal line, applied thereto a resetting switch signal voltage VRef, and connected to the control terminal of the third switch element M4; and a driving switch signal line, applied there to a driving switch signal voltage VEmission, and connected to a control terminal of the first switch element M2 and a control terminal of the fourth switch element M5.

Of course, the zero point of potential of all bias voltages is connected to a same common terminal, and the zero point of potential of all signal voltages is also connected to a same common terminal.

Alternatively, the driving transistor and the first to fifth switch elements are all thin film transistors TFTs.

By corresponding to the above feature, the first terminal (input terminal) of the driving transistor and the first terminals of the first to fifth switch elements represent sources, the second terminal (output terminal) of the driving transistor and the second terminals of the first to fifth switch elements represent drains, and the control terminal of the driving transistor and the control terminals of the first to fifth switch transistors represent gates. Further, TFTs adopted in the present embodiment are P channel type thin film transistors.

Since the pixel compensation circuit in the embodiment comprises six TFTs and one capacitor, it can be called as a new type 6T1C pixel compensation circuit according to the common naming way in the art.

Figure 2:
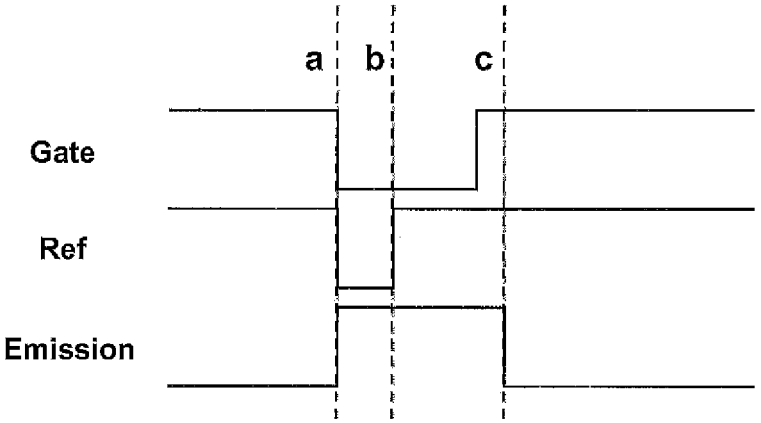
FIG. 2 is an operation timing diagram of a pixel compensation circuit in an embodiment of the present disclosure.

Based on the circuit connection under the above conditions, the operation principle of the circuit can be described as follows:

FIG. 2 shows an operation timing diagram of the circuit. As shown in FIG. 2, Gate, Ref, Emission represent a writing switch signal, a resetting switch signal, and a driving switch signal respectively. In general, the operation of the circuit is divided into three phases: a resetting phase (a-b), a data writing and threshold voltage latching phase (b-c) and a light emitting phase (c-).

In the resetting phase (a-b), Ref and Gate are at a low level. Since Gate is at the low level, the transistors M3 and M6 are turned on. The turn-on of M3 makes the potential at node A of the storage capacitor C1 become VData, while the turn-on of M6 connects the gate and drain of the driving transistor M1, so that M1 forms a diode connection and is in the turn-on state. At this time, since Ref is also at the low level, the transistor M4 is turned on. Now, a loop composed of the transistors M1, M6 and M4 will be formed.

Thus, in resetting phase, node B of the storage capacitor C1 connected to the loop is controlled by the circuit of M4, M1 and M6. Since M4 is directly connected to a power supply signal, so that a signal at node B is controlled by M4 instead of by the loop of M1 and M6. Therefore, at this time, the potential at node B is Vinitial potential. In the resetting phase of each frame, the node B will be reset to the Vinitial potential. The potential of node A at the other terminal of the storage capacitor is controlled by M3. At this time, VData is directly loaded. Therefore, in the resetting phase, the potentials at the terminals A and B of the storage capacitor will be stabilized at VData and Vinitial respectively.

In the data writing and threshold voltage latching phase (b-c), Ref is at a high level, so that M4 is turned off and the node B is controlled only by the loop of M1 and M6. At this time, M1 is still in the diode connecting mode. Therefore, the potential at node B is written a sum of $V_{DD}$ and the threshold voltage Vth, while the potential at node A is also directly loaded VData by M3. When this phase ends, the potentials at the two terminals A and B of the storage capacitor are VData and $V_{DD}$+Vth respectively.

In the light emitting phase, Gate is at the high level, and thus the transistors M3 and M6 are turned off. The Emission signal is at the low level, and thus the transistors M5 and M2 are turned on. The turn-on of M5 makes the potential of node A at one terminal of the storage capacitor C1 become Vinitial. According to the principle of capacitive charge conservation, the potential at node B becomes Vinitial+$V_{DD}$+Vth−VData, i.e., making the gate signal of the driving transistor M1 become Vinitial+$V_{DD}$+Vth−VData. Since M1 operates in a saturation region, it can be known according to the current formula in the saturation region of transistors:

$$\begin{aligned} I_{DS} &= \frac{1}{2}K(V_{GS} - Vth)^2 \\ &= \frac{1}{2}K(Vinitial + V_{DD} + Vth - VData - V_{DD} - Vth)^2 \\ &= \frac{1}{2}K(Vinitial - VData)^2 \end{aligned}$$

where K in the same structure is relatively stable, and can be regarded as a constant.

Therefore, in the process that OLED emits light, the current flowing through the organic light emitting diode connected to the drain of the driving transistor M1 is only related to Vinitial and VData signals, but is unrelated to Vth and $V_{DD}$. Since Vinitial will not form a current loop, the influence of Vinitial IR Drop (voltage drop, i.e., the voltage attenuation on the signal line as mentioned in the background of the present disclosure) does not exist. Thus, the problem of non-uniformity of current flowing through OLED due to non-uniformity of Vth caused by the backplane manufacturing process will not occur and the problem of non-uniformity of light emitting will not be caused either. At the same time, the potential at node A of the storage capacitor is always the Vinitial signal in the process of emitting light, and thus no charge loss occurs, which ensures the stability of the potential at node B so that the current of M1 is stable and thus the organic light emitting diode emits light stably.

Of course, the above embodiment is just used for describing the principle of the present disclosure, but not used for limiting the present disclosure. Although the present disclosure has been described in detail by referring to the above embodiments, those skilled in the art shall understand: no matter what kind of voltage bias is adopted, what kind of control line is adopted to control connection or what kind of specific switches, capacitors and transistor elements are adopted in the specific implementation processes, it can be implemented by referring to the operation principle described in the embodiments of the present disclosure, without departing from the spirit and scope of the technical solutions in the respective embodiments of the present disclosure.

Second Embodiment

Based on the same inventive concept, there further provides an embodiment of the present disclosure an array substrate comprising any one of the above pixel compensation circuit. Since the array substrate provided in the embodiments of the present disclosure has the same technical features as any one of the above pixel compensation circuits, it can solve the same technical problems and produce the same technical effects.

Third Embodiment

Based on the same inventive concept, there further provides in an embodiment of the present disclosure a display apparatus comprising any one of the array substrates. The display apparatus can be any product or components having a display function, such as an electronic paper, an OLED panel, a mobile phone, a tablet computer, a TV set, a display, a notebook computer, a digital photo frame, and a navigator and so on.

Since the display apparatus provided in the embodiment of the present disclosure has the same technical features as any one of the above array substrates, it can solve the same technical problems and produce the same technical effects.

To sum up, the pixel compensation circuit, the array substrate and the display apparatus provided in the present disclosure can not only compensate for OLED current deviation caused by the threshold voltage offset, but also have the function of compensating for the influence of signal voltage attenuation on current.

At the same time, such circuit structure further has a function of resetting the potential at the gate of the driving TFT from frame to frame, which ensures to minimize the influence of an upper frame signal on a lower frame signal and greatly reduces the influence of signals from frame to frame.

The above embodiments are just used for describing the technical solutions of the present disclosure, but not used for limiting the technical solutions of the present disclosure. Although the embodiments of the present disclosure have been described in detail by referring to the embodiments as described above, those skilled in the art shall understand: the technical solutions disclosed in the above embodiments can be amended, or a part of technical features can be replaced by equivalent technical features. And these amendments or replacements do not depart from the spirit and scope of the present disclosure defined in the Claims.

The present application claims a priority of a Chinese patent application No. 201410111760.X filed on Mar. 24, 2014. The content disclosed by the Chinese patent application is incorporated by reference herein in full as a part of the present disclosure.

What is claimed is:

1. A pixel compensation circuit, comprising an organic light emitting diode, a driving transistor, first to fifth switch elements and a storage capacitor, wherein:

an anode of the organic light emitting diode is connected to a second terminal of the first switch element;

a first terminal of the first switch element is connected to an output terminal of the driving transistor and a first terminal of the fifth switch element;

a control terminal of the driving transistor is connected to a second terminal of the third switch element, a second terminal of the fifth switch element and a first terminal of the storage capacitor;

a second terminal of the storage capacitor is connected to a second terminal of the fourth switch element and a second terminal of the second switch element;

the pixel compensation circuit further comprises a driving switch signal line connected to a control terminal of the first switch element and a control terminal of the fourth switch element;

the pixel compensation circuit further comprises a data writing voltage line connected to a first terminal of the second switch element;

wherein a first terminal of the third switch element is connected to a first terminal of the fourth switch element.

2. The pixel compensation circuit according to claim 1, wherein it further comprises:

a first driving voltage line connected to an input terminal of the driving transistor; and a second driving voltage line connected to a cathode of the organic light emitting diode.

3. The pixel compensation circuit according to claim 1, wherein it further comprises: an initialization voltage line connected to the first terminal of the third switch element and the first terminal of the fourth switch element.

4. The pixel compensation circuit according to claim 1, wherein it further comprises: a writing switch signal line connected to a control terminal of the second switch element and a control terminal of the fifth switch element.

5. The pixel compensation circuit according to claim 1, wherein it further comprises: a resetting switch signal line connected to a control terminal of the third switch element.

6. The pixel compensation circuit according to claim 1, wherein the driving transistor and the first to fifth switch elements are thin film transistors.

7. An array substrate comprising the pixel compensation circuit according to claim 1.

8. A display apparatus comprising the array substrate according to claim 7.

9. The array substrate according to claim 7, wherein the pixel compensation circuit further comprises:

a first driving voltage line connected to an input terminal of the driving transistor; and a second driving voltage line connected to a cathode of the organic light emitting diode.

10. The array substrate according to claim 7, wherein pixel compensation circuit further comprises: an initialization voltage line connected to the first terminal of the third switch element and the first terminal of the fourth switch element.

11. The array substrate according to claim 7, wherein pixel compensation circuit further comprises: a writing switch signal line connected to a control terminal of the second switch element and a control terminal of the fifth switch element.

12. The array substrate according to claim 7, wherein pixel compensation circuit further comprises: a resetting switch signal line connected to a control terminal of the third switch element.

13. The array substrate according to claim 7, wherein, in the pixel compensation circuit, the driving transistor and the first to fifth switch elements are thin film transistors.

* * * * *